US006793893B2

(12) United States Patent
Kleinsasser

(10) Patent No.: US 6,793,893 B2
(45) Date of Patent: Sep. 21, 2004

(54) SEMEN STORAGE

(75) Inventor: Jonathan Kleinsasser, Ste. Agathe (CA)

(73) Assignee: Crystal Spring Colony Farms Ltd., Ste. Agathe (CA)

( * ) Notice: Subject to any disclaimer, the term of this patent is extended or adjusted under 35 U.S.C. 154(b) by 759 days.

(21) Appl. No.: 09/727,458

(22) Filed: Dec. 4, 2000

(65) Prior Publication Data

US 2001/0002985 A1 Jun. 7, 2001

Related U.S. Application Data

(63) Continuation-in-part of application No. 09/414,850, filed on Oct. 12, 1999, now abandoned.

(51) Int. Cl.[7] ..... B01L 9/06

(52) U.S. Cl. ..... 422/104; 422/102; 435/2; 211/71.01; 211/77; 211/78; 366/144; 366/197; 366/202

(58) Field of Search ..... 422/99, 102, 104; 435/2; 211/74, 71.01, 77, 78; 366/144, 197, 202, 203, 208, 210, 211, 212, 215

(56) References Cited

U.S. PATENT DOCUMENTS 3,625,485 A * 12/1971 Adler ..... 366/216
3,980,227 A * 9/1976 Witty et al. ..... 494/7
4,262,494 A * 4/1981 Karow, Jr. ..... 62/384
4,609,017 A * 9/1986 Coulter et al. ..... 141/1
4,861,553 A * 8/1989 Mawhirt et al. ..... 422/65
5,284,623 A * 2/1994 Yamori et al. ..... 422/99
5,578,268 A * 11/1996 Champseix et al. ..... 422/63
5,632,388 A * 5/1997 Morrison et al. ..... 211/74
5,983,661 A * 11/1999 Wiesman ..... 62/457.1
6,059,446 A * 5/2000 Dschida ..... 366/215

* cited by examiner

*Primary Examiner*—Maureen M. Wallenhorst
(74) *Attorney, Agent, or Firm*—Adrian D. Battison; Michael R. Williams; Ryan W. Dupuis

(57) ABSTRACT

A method of storing semen includes a series of carrying trays mounted on a rack mounted within a refrigerated container. Each tray supports a plurality of tubes containing the semen with the tubes having a main body being cylindrical in shave. The rack is arranged to store the samples in a manner such that the samples are continuously mixed. The rack provides movement to the tubes for mixing. The housing may rotate about an axis such that the tubes are moved about the axis or the housing may tilt the tubes such that the sample mixes that samples end to end. The tubes can be removed from the rack on the trays for use.

6 Claims, 9 Drawing Sheets

SEMEN STORAGE

This application is a continuation in part of U.S. application Ser. No. 09/414,850 filed Oct. 12, 1999 now abandoned.

FIELD OF THE INVENTION

The present invention relates to a method and apparatus for storing semen.

BACKGROUND

Generally when a person is collecting boar semen and the like the semen is collected and stored after mixing with other components in tubes and the tubes are placed in a box or basket. Placing the tubes in a basket for storage and transportation to the site of use is an unsatisfactory way to store the semen. It is known that it is desirable to periodically rotate the tubes to prevent settling of particulates to the bottom of the tube.

SUMMARY

It is one object of the present invention to provide an improved rack which allows ready transportation of the tubes.

It is a further object of the present invention to provide an improved rack which can be readily rotated in a support to prevent settling of the contents.

According to the present invention there is provided a biological sample storage rack comprising;

- a housing in which a plurality of tubes containing the biological sample are located, the tubes having a main body being cylindrical in shape and having a nozzle at a respective end of the main body;
- at least one mounting member on the housing having a horizontal axis; and
- a plurality of holes on the mounting member for receiving the tubes each having an axis parallel to the axis of the mounting member;
- and a support for the housing arranged to rotate the housing about the axis of the plate such that the biological sample within the tubes does not settle.

Preferably the mounting member comprises a first plate having a plurality of holes which are arranged to receive the main body such that the main body is located within the holes on the plate and a second plate which is located adjacent to the first plate and has a plurality of holes coaxial with the holes on the first plate such that the holes on the second plate are arranged to receive the nozzle.

Preferably a third plate is located on a respective side of the second plate relative to the first plate on the axis which has a plurality of holes each having an axis parallel to the axis of the holes on the first plate but are staggered such that each axis is side by side on a respective plate, the third plate is arranged to receive a second plurality of tubes such that the main body is located within the holes and the nozzles on the tubes are located within a second plurality of holes on the second plate such that the nozzles are facing inward adjacent to each nozzle.

Preferably the housing is generally cylindrical and there is provided a cradle is arranged to receive the housing such that the housing can be rotated on the cradle, the cradle has a frame having a first side and a second side wherein a plurality of roller bars arranged in an arc are connected to each side such that the rollers have an axis parallel to the axis of the housing when the housing is located thereon.

Preferably a shaft is located on the axis of the housing and extends horizontally therethrough and is coupled to a hanger on the support member at one end and is coupled to a rotating mechanism at an opposed end, wherein the rotating mechanism is arranged to rotated the shaft about the axis such that the housing is rotated.

According to a second aspect of the invention there is provided a biological sample storage rack comprising a housing in which a plurality of tubes containing the biological sample are located, the tubes having a main body being cylindrical in shape and having a nozzle at a respective end of the main body, the housing having a first plate with a plurality of holes which are arranged to receive the main body such that the main body is located within the holes on the plate and a second plate which is located adjacent to the first plate and has a plurality of holes coaxial with the holes on the first plate such that the holes on the second plate are arranged to receive the nozzle.

Preferably a third plate is located on an opposite side of the second plate relative to the first plate on the axis which has a plurality of holes each having an axis parallel to the axis of the holes on the first plate but are staggered such that each axis is side by side on a respective plate, the third plate is arranged to receive a second plurality of tubes such that the main body is located within the holes and the nozzles on the tubes are located within a second plurality of holes on the second plate such that the nozzles are facing inward adjacent to each nozzle.

According to a second embodiment of the present invention there is provides a semen storage rack comprising:

- an upright frame arranged to be located within a refrigerator;
- a plurality of racks pivotally mounted to the frame arranged to tilt thereon;
- a plurality of trays each arranged to be located on a rack;
- at least one container arranged to contain semen and is located in the tray; and,
- a drive mechanism arranged to tilt each rack about an axis such that the contents of the container does not settle.

Preferably the racks are spaced one on top of the other on the frame.

Preferably the racks are mounted on support beams sufficiently vertically spaced so that a tray can be slid onto a rack.

Conveniently there is two rows of racks.

Preferably a connector rod is pivotally mounted to each rack such that the racks are tilted simultaneously by the drive mechanism.

Conveniently there is two connector rods each being pivotally mounted to a respective row of racks such that each row of racks are tilted simultaneously.

Conveniently a cross connector rod is pivotally mounted to each connector rod on a respective row of racks such that the rows tilt simultaneously.

Preferably the drive mechanism is a motor which drives a cam for providing upwards and downwards rocking motion to each rack.

Preferably the containers are elongate tubes positioned on the tray such that the containers are transverse to the axis of the racks for mixing the fluid end to end within the container.

According to the present invention there is provided a method of storing semen includes:

- providing the semen in a plurality of storage tubes;
- providing a rack;
- locating the rack in a refrigerator;
- providing a carrier for a plurality of storage tubes;
- locating the carrier on the rack; and,
- operating the rack to effect movement of the carrier.

BRIEF DESCRIPTION OF THE DRAWINGS

In the accompanying drawings, which illustrate an exemplary embodiment of the present invention.

DETAILED DESCRIPTION

Figure 3:
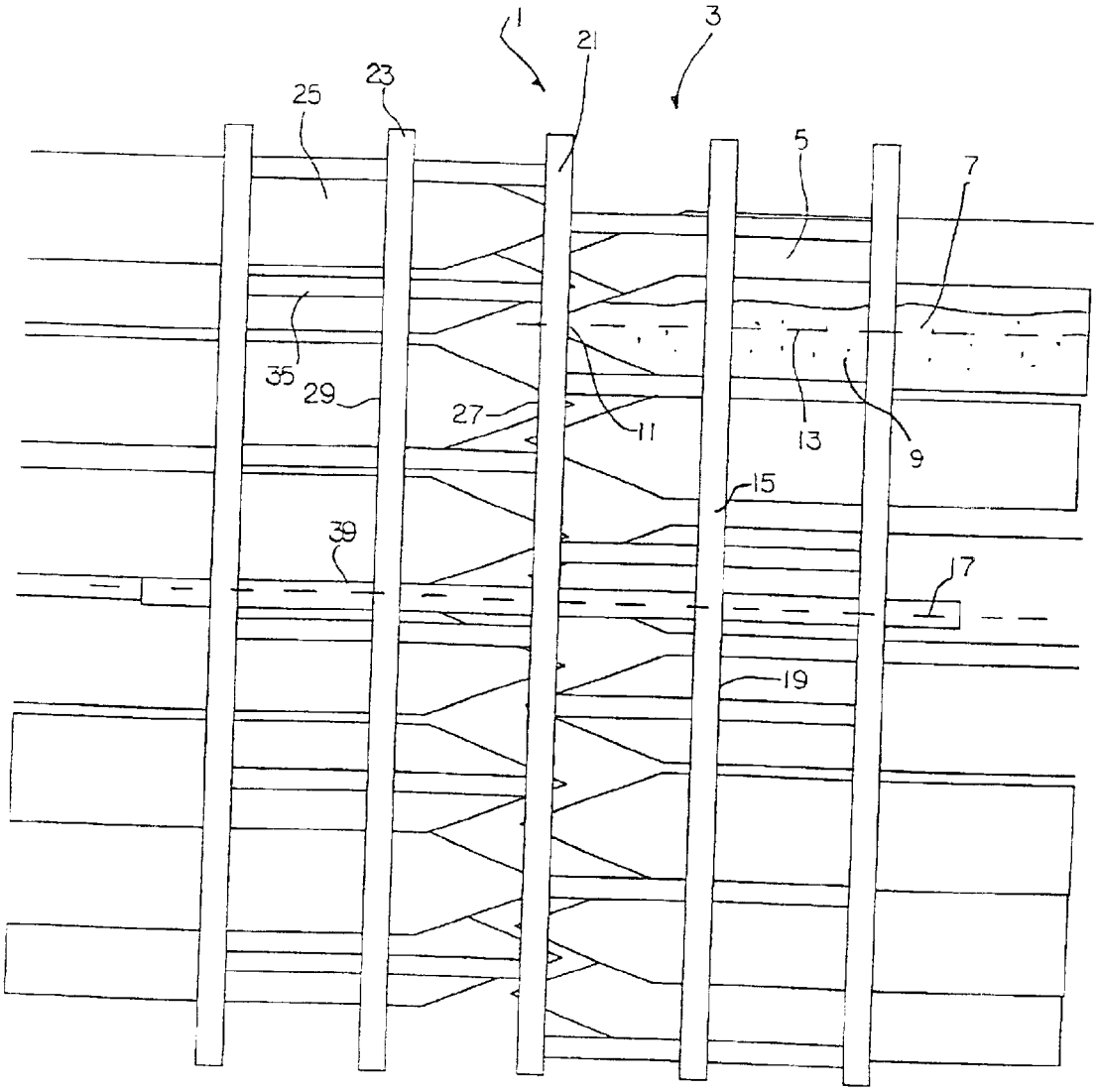
FIG. 3 is a side elevational view of the present invention.
Figure 4:
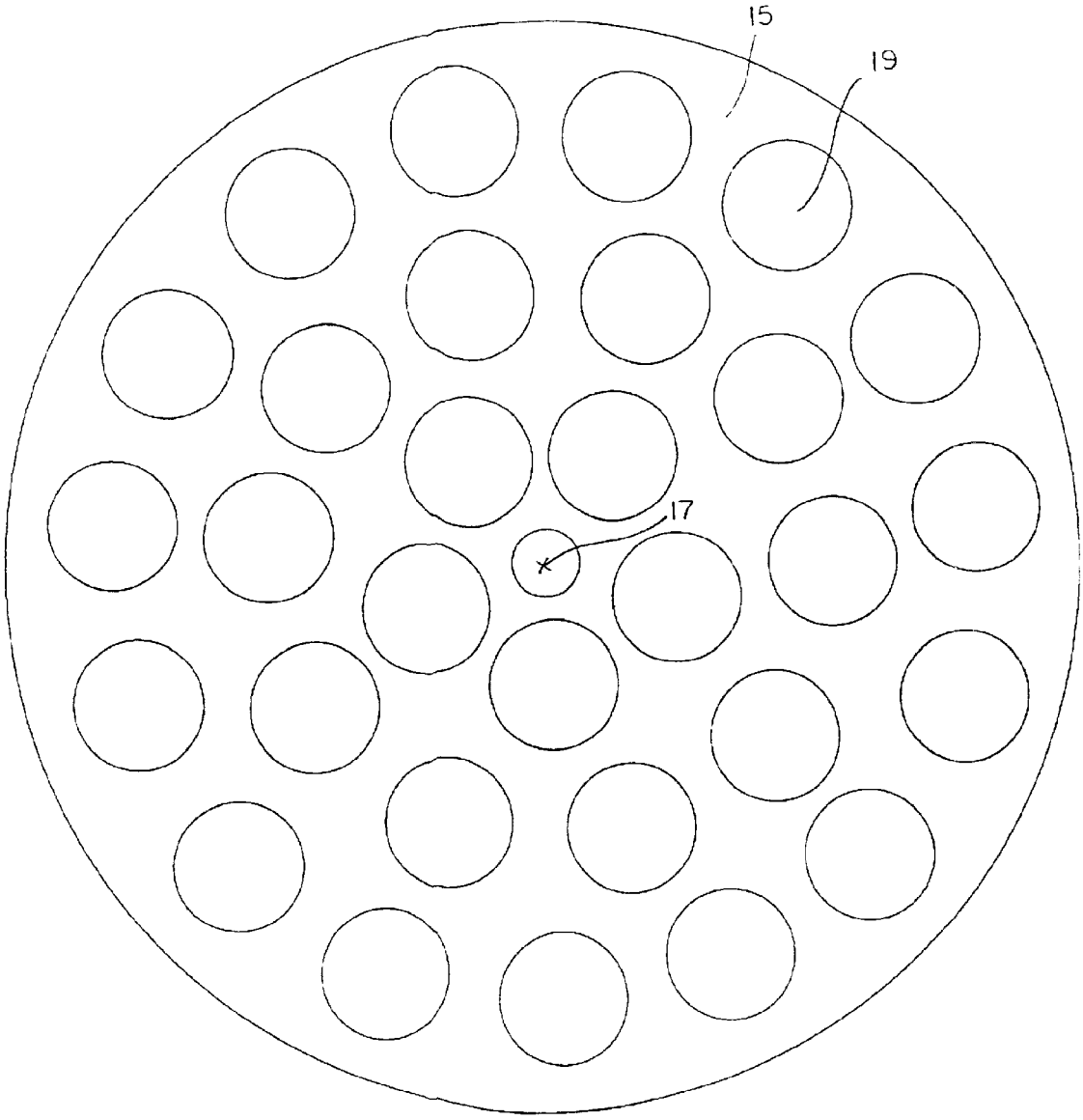
FIG. 4 is a vertical cross section along the lines 4—4 of FIG. 3.

Referring to the accompanying drawings, there is illustrated a boar semen storage rack 1 which has a housing 3 for supporting and storing a plurality of tubes 5 which contain boar semen 7 and the like, as best shown in FIG. 3. The tubes are arranged one the rack in a horizontal manner and are cylindrical in shape having a main body 9 and a nozzle 11 at an end of each tube. Each tube has an axis 13 which is horizontal such that each axis of each tube is parallel relative to each tube.

The rack has a plurality of plates 15 which are arranged to support the plurality of tubes such that the tubes are positioned on the horizontal axis. The plates are vertically orientated and have a horizontal axis 17 such that the axis is parallel to the axis of the tubes. The plates are equidistantly spaced and has a plurality of holes 19 which are arranged to receive the tubes and support the main body such that a respective end of the tubes face outwardly. A center plate 21 is arranged to support the nozzle of the tube and is located on a respective side of the plates, the center plate is coaxial with the plates. A second plurality of plates 23 are located on respective side of the center plate relative to the first plurality of plates such that a second set of tubes 25 can be supported and stored by the rack. The tubes are situated on the plates such that the nozzle is facing inward and is supported by the center plate which has a plurality of holes 27. The second plates have a plurality of holes 29 which have an axis parallel to the holes on the first plate but are positioned in a staggered manner relative to the first holes. The center plate has a first set of holes 31 of the plurality of holes which are coaxial with the holes on the first plate and has a second set of holes 33 which are coaxial with the holes on the second plate such that the maximum amount of tubes can be located on the rack at one time. Each plate is connected by brackets 35 which are located between each plate parallel to the axis.

Figure 1:
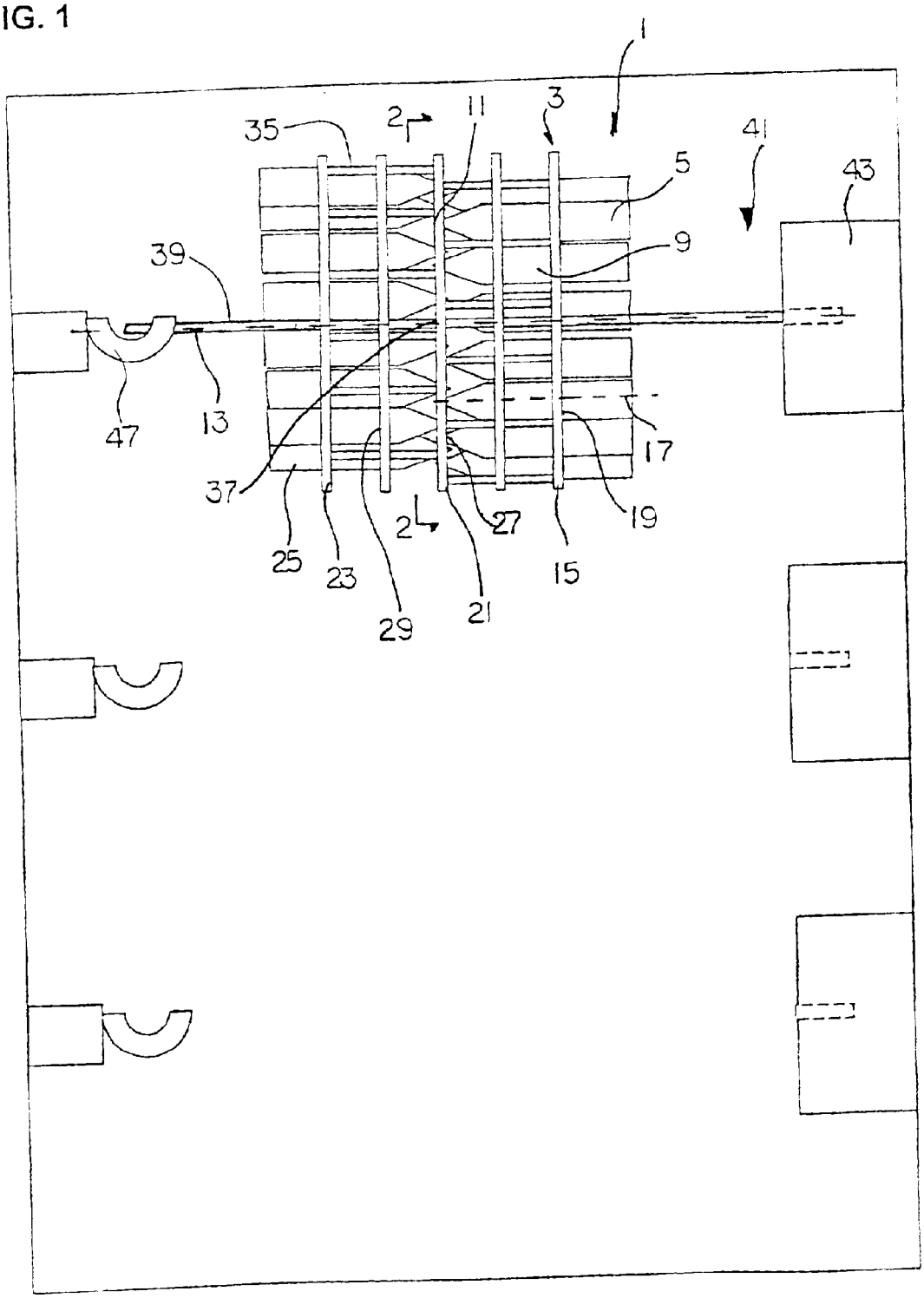
FIG. 1 is a side elevational view one embodiment of the present invention located on a rotating mechanism.
Figure 2:
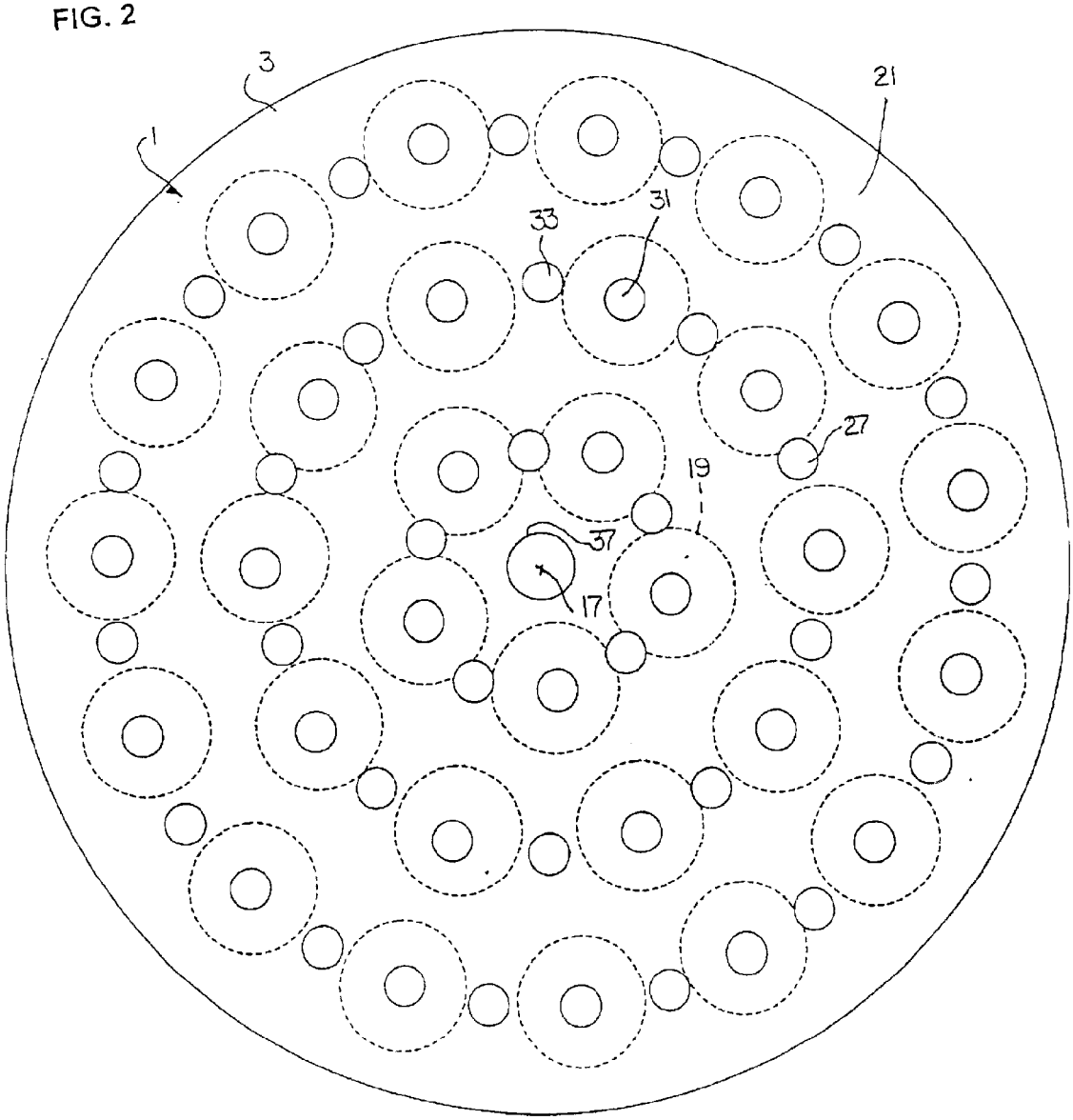
FIG. 2 is a vertical cross section along the lines 2—2 of FIG. 1.

Each plate has a shaft hole 37 which located on the axis of the plate and is arranged to receive a shaft 39. The shaft is arranged such that the rack can be rotated about the axis so that the semen does not settle in the tubes. The shaft can be coupled to a rotating mechanism 4, as shown in FIG. 1, which has a motor 43 for receiving one end of the shaft and a hanger 45 for receiving a second end of the shaft. The rotating mechanism is arranged to support the rack such that the axis is horizontal. The motor rotates the rack periodically or at a slow constant rate so that the semen is not agitated while rotating.

Figure 5:
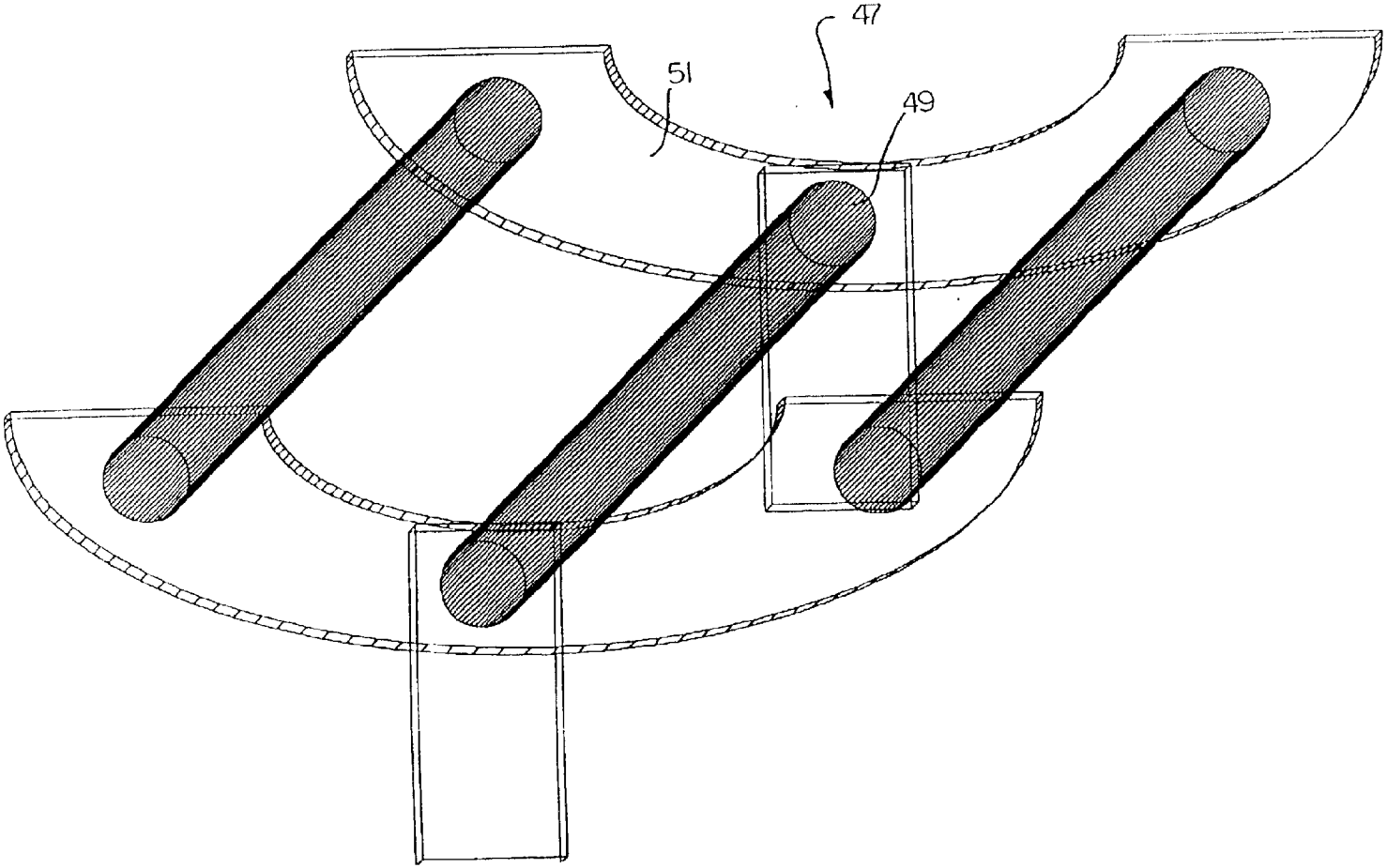
FIG. 5 is an isometric view of a cradle for the rack the present invention.

A second method of rotating the rack is shown in FIG. 5 wherein a cradle 47 is arranged to support the rack by cradling the plates therein and has a plurality of roller bars 49 pivotally arranged in an arc and mounted at each end to a frame 51 such that the rack can be rotated by a motor which drives the rollers on the cradle for rotating the rack.

Figure 6:
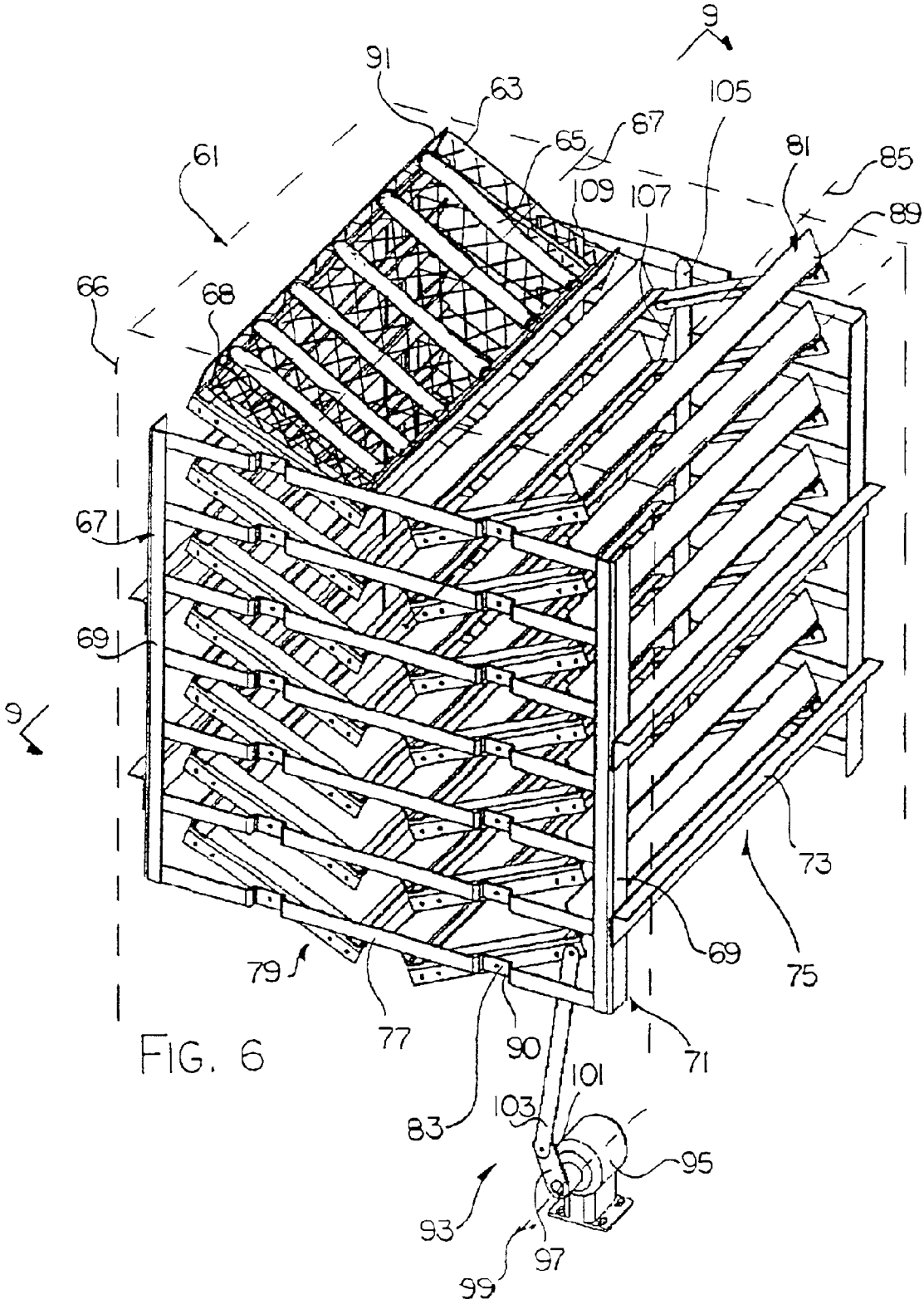
FIG. 6 is an isometric view of a second embodiment of the present invention.
Figure 7:
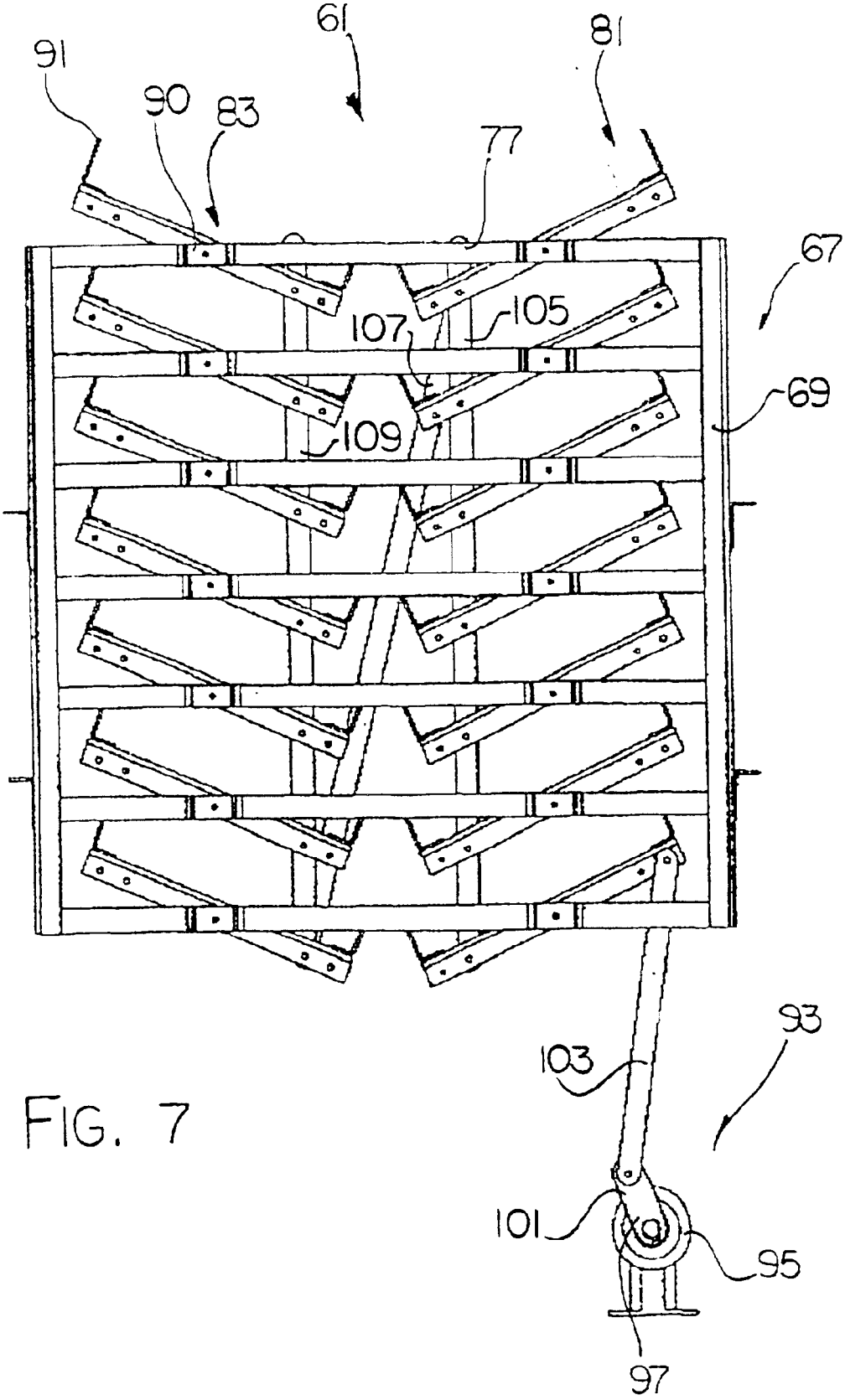
FIG. 7 is a front elevational view of the embodiment shown in FIG. 6.
Figure 8:
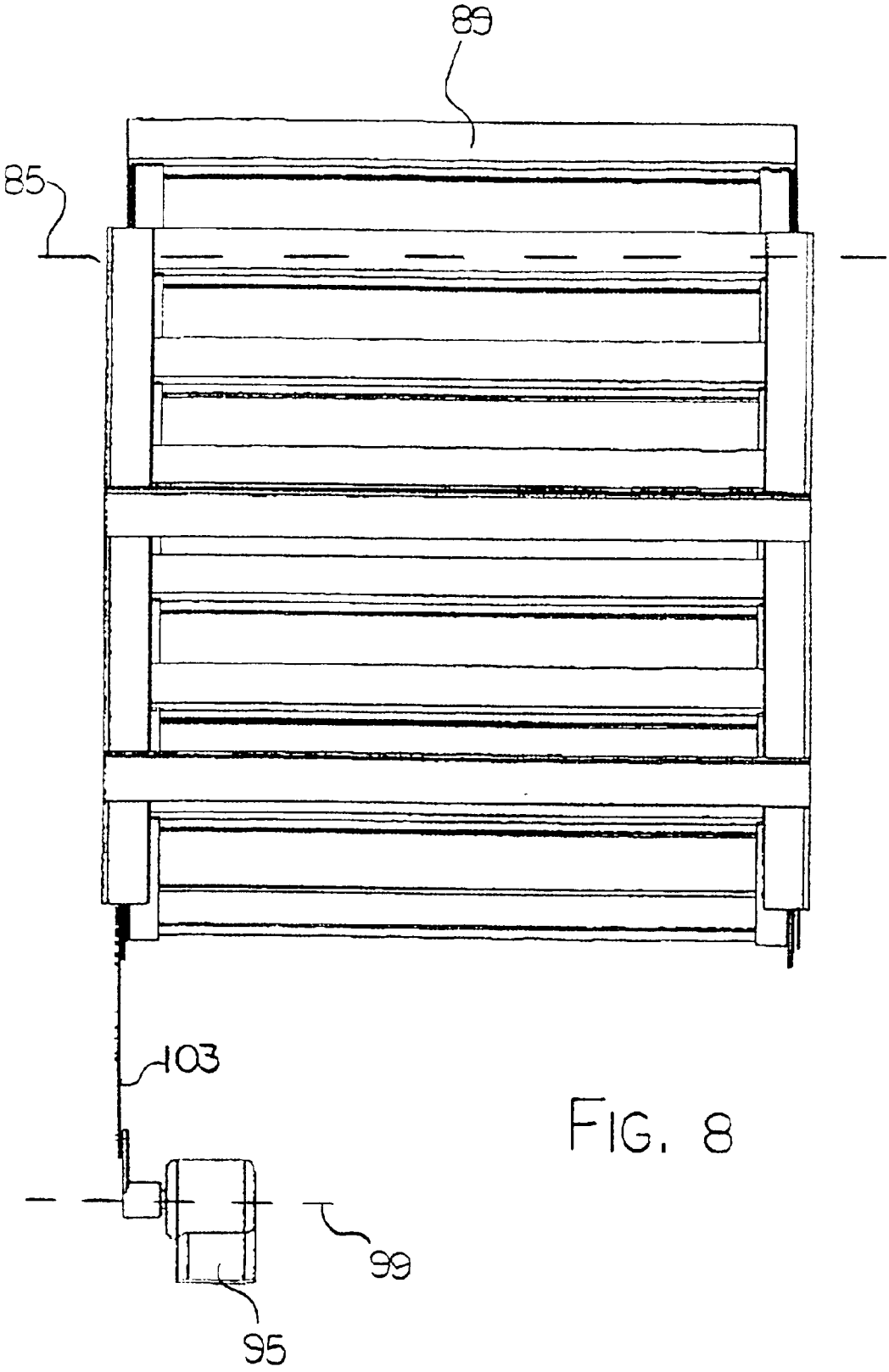
FIG. 8 is a side elevational view of the embodiment shown in FIG. 6.
Figure 9:
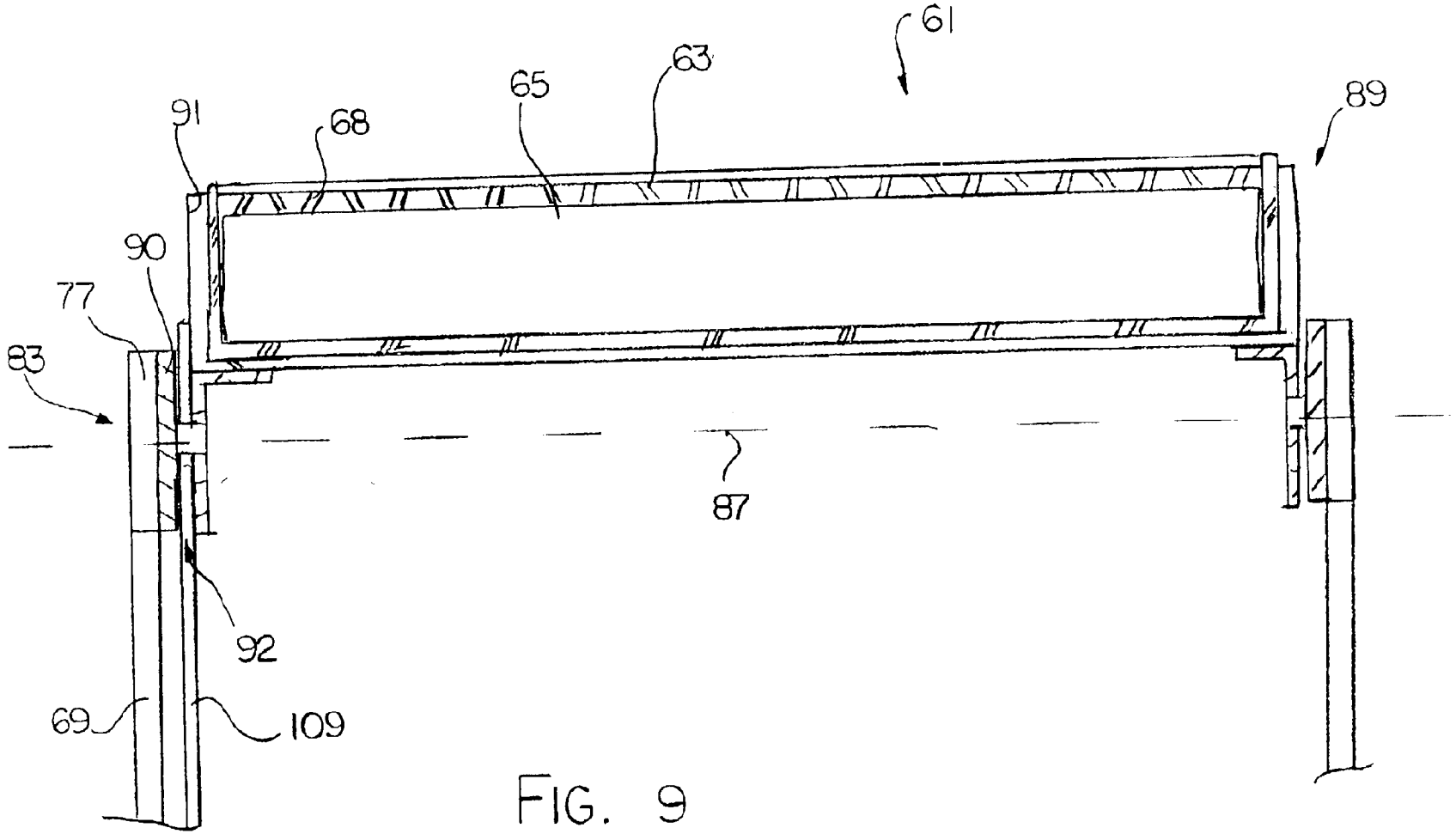
FIG. 9 is a vertical cross section along the lines 9—9 in FIG. 6.

FIGS. 6, 7 and 8 show a second embodiment of the present invention. The second embodiment is a semen rack, generally indicated at 61, which is arranged to support a plurality of trays 63, each tray holding a plurality of semen sample tubes 65. The trays are removable from the rack so that the trays can be transported from the rack and so that the tubes can be filled at the particular job site, placed within the tray which is then placed on the rack for storage. The rack is arranged to be located within a cooler or refrigerator 66 for maintaining the desired temperature of the samples within each tube. The trays are wire mesh having upward sides 68 for supporting the tube and are sufficient size to fit in the racks, as described below.

The rack has a square frame 67 having four vertically oriented elongate posts 69 spaced apart such that each post defines a corner 71 of the frame. Support beams 73 extend horizontally across opposing sides of the frame connecting respective posts to each other. The beams are parallel and equal in length such that the distance between the respective posts is equal. The sides where the beams are located are defined as open sides 75. The beams can be arranged to slide onto a shelving arrangement within the cooler.

A plurality of tray support beams 77 connect the respective posts on respective sides of the frame which are not connected by the support beams and are located on opposing sides of the frame. The tray support beams are spaced equidistantly along the length of the post such that each tray support beam is parallel and each respective tray support beam on a respective side of the frame are at equal heights on the posts. The sides of the frame where the tray support beams are located is defined at the pivot side 79.

Each tray support beam supports a pair of tray racks 81. Each tray support beam has a rack mount 83 spaced horizontally on the beam. The mount on each respective beam on respective sides of the frame are coaxial such that each tray beam has a first set of axis 85 along one side one on top of the other on each beam and a second set of axis 87 along an opposite side one on top of the other on each beam. Each individual rack 89 is connected at each end to a respective tray support beam at each respective axis such that the rack can pivot about each axis. The tray support beam has an inwards portion 90 where the rack connects which provides sufficient space 92 between the racks and the frame, as mentioned later.

Each rack is rectangular in shape being narrow enough in width such that each rack on a tray support beam is spaced so that the racks are unable to contact the respective rack when tilting about the respective axis. A flange 91 extends upwards from each side and along the length of each rack parallel to the axis such that the tray can be located on the rack supported from lateral movement by the flange. The tray is located within each rack and is supported by the flanges therein and the tubes are positioned side by side transverse to the axis of the rack.

A drive mechanism 93 is arranged to continuously tilt the racks at a constant rate of speed. The drive mechanism has a motor 95 which drives a cam 97 about an axis 99 which is parallel to the axis of the racks. The cam rotates about the axis and has a cam arm 101 extending radially outwards from axis. At an outer end of the cam arm is a connector arm 103 which is pivotally mounted to the cam arm and extends to one of the plurality of racks and is pivotally mounted thereto adjacent to and between the end of the rack and the beam at a furthermost portion of the rack from the axis. As shown in this embodiment the connector arm is coupled to the bottom rack on one row of racks. Movement of the cam arm raises and lowers the arm such that the rack tilts in a rocking action on the axis. Each row of racks is connected by a connector rod 105 spaced from the axis. The connector rod is pivotally mounted to each rack such that movement of a single rack forces the rod upwards or downwards providing simultaneous rocking movement about the axis of each rack to the entire row of racks. A second connector rod 107 is pivotally mounted to a top end of the first connector rod and extends downwards to a third connector rod 109 on the second row of racks. The connector rods are located between the frame and the racks within the space 92, as mentioned earlier, provided by the inward portion on the tray support beam. The second connector rod is pivotally mounted to the third connector rod and is arranged to move upwards and downwards with movement of the first connector rod which provides movement of the third connector rod. The third connector rod is pivotally mounted to each rack spaced from the axis such that upwards and downwards movement of the third connector rod which is driven by the second connector rod with is driven by the first connector rod with is ultimately driven by the motor provides simultaneous rocking motion to the racks. The rocking movement of the racks continuously mixes the fluid within the tubes in a direction end to end therein.

The semen rack is located within a cooler or refrigerator such that a respective pivot side is facing outwards providing access to each rack. Trays can be slide into the racks from the pivotal side so that the entire semen rack remains stationary and permanently within the cooler. The front posts of the frame extend downwards such that they are longer than the rear posts for providing an appropriate fit within the cooler.

While one embodiment of the present invention has been described in the foregoing, it is to be understood that other embodiments are possible within the scope of the invention. The invention is to be considered limited solely by the scope of the appended claims.

What is claimed is:

1. A method of storing and supplying semen comprising:

providing the semen in a plurality of separate storage tubes;

providing a transportable carrying member for receiving and supporting a plurality of the separate storage tubes;

providing a container having a refrigerated interior for receiving and storing the semen within the storage tubes on the transportable carrying member;

providing in the refrigerated interior a mounting member for the transportable carrying member with the mounting member in piece within the refrigerated interior piecing the transportable carrying member on the mounting member;

with the mounting member in place within the refrigerated interior, repeatedly operating the mounting member to effect movement of the transportable carrying member with the separate storage tubes thereon so as to prevent settling of particulates in the semen to the bottom of its respective separate storage tube;

and storing the separate storage tubes on the transportable carrying member on the mounting member in the refrigerated interior while repeatedly operating the mounting member to effect said movement the transportable carrying member being removed with the separate storage tubes thereon from the mounting member for transportation of the semen.

2. The method according to claim 1 wherein there is provided a plurality of the transportable carrying members each having a plurality of said separate storage tubes and wherein the mounting member is arranged to simultaneously receive end to simultaneously effect said movement of said plurality of transportable carrying members, each of the transportable carrying members being separately removable from the mounting member.

3. A method of storing and supplying semen comprising:

providing the semen in a plurality of separate storage tubs;

providing a transportable carrying member for receiving and supporting a plurality of the separate storage tubes;

providing a container having a refrigerated interior for receiving and storing the semen within the storage tubes on the transportable carrying member;

providing in the refrigerated interior a mounting member for the transportable carrying member;

with the mounting member in place within the refrigerated interior placing the transportable carrying member on the mounting member;

with the mounting member in place within the refrigerated interior, repeatedly operating the mounting member to effect movement of the transportable carrying member with the separate storage tubes thereon so as to prevent setting of particulates in the semen to the bottom of its respective separate storage tube;

and storing the separate storage tubas on the transportable carrying member on the mounting member in the refrigerated interior while repeatedly operating the mounting member to effect said movement;

the transportable carrying member being removed with the separate storage tubes thereon from the mounting member for transportation of the semen;

the mounting member and the transportable carrying member being arranged such that the separate storage tubes, with the transportable carrying member in place on the mounting member within the refrigerated interior, are arranged with a longitudinal axis of each tube generally horizontal;

the mounting member and the transportable carrying member being arranged such that, with the transportable carrying member in place on the mounting member within the refrigerated interior, said movement of the separate storage tubes is effected about a horizontal tilt axis generally at right angles to said longitudinal axle to rock the longitudinal axis back and forth about said tilt axis to mix the semen within the tubes end to end of the tube.

4. The method according to claim 3 wherein there is provided a plurality of the transportable carrying members each having a plurality of said separate storage tubes and wherein the mounting member is arranged to simultaneously receive and to simultaneously effect said movement of said plurality of transportable carrying members, each of the transportable carrying members being separately removable from the mounting member.

5. The method according to claim 4 wherein the plurality of the transportable carrying members are mounted in a stack one above the next on the mounting member.

6. A method of storing and supplying semen camp rising:

providing the semen in a plurality of separate storage tubes;

providing a plurality of transportable carrying trays each for receiving and supporting a plurality of the separate storage tubes;

providing a container having a refrigerated interior for receiving and storing the semen within the storage tubes on the transportable carrying trays, providing in the refrigerated interior a mounting rack having a plurality of separate receptacles arranged in a upright stack each for receiving and supporting a respective one of the transportable carrying trays;

with the mounting rack in place within the refrigerated interior placing the transportable carrying trays in the separate receptacles on the mounting member;

with the mounting rack in place within the refrigerated interior, repeatedly operating the mounting rack to effect movement of the transportable carrying trays with the separate storage tubes thereon so as to prevent settling of the particulates in the semen to the bottom of its respective separate storage tube;

and storing the separate storage tubes on the transportable carrying trays on the mounting rack in the refrigerated interior while repeatedly operating the mounting rack to effect said movement;

the transportable carrying trays being individually removed with the separate storage tubes thereon from the stack of receptacles of the mounting rack for transportation of the semen;

the mounting rack and the transportable carrying trays being arranged such that the separate storage tubes, with the transportable carrying trays in place on the mounting rack within the refrigerated interior, are arranged with a longitudinal axis of each tube generally horizontal;

the mounting rack and the transportable carrying trays being arranged such that, with the transportable carrying trays in place on the mounting rack within the refrigerated interior, said movement of the separate storage tubes is effected about a horizontal tilt axis generally at right angles to said longitudinal axis to rock the longitudinal axle back and forth about said tilt axis to mix the semen within the tubes end to end of the tubes.

* * * * *